United States Patent [19]

Stenlund

[11] Patent Number: 4,964,459

[45] Date of Patent: Oct. 23, 1990

[54] HEAT EXCHANGER

[75] Inventor: Stig Stenlund, Bataljvägen, Sweden

[73] Assignee: Hypeco AB, Malmo, Sweden

[21] Appl. No.: 224,945

[22] PCT Filed: Feb. 18, 1988

[86] PCT No.: PCT/SE88/00070

§ 371 Date: Jul. 28, 1988

§ 102(e) Date: Jul. 28, 1988

[87] PCT Pub. No.: WO88/06707

PCT Pub. Date: Sep. 7, 1988

[30] Foreign Application Priority Data

Feb. 24, 1987 [SE] Sweden ..... 8700773

[51] Int. Cl.[5] ..... F28D 7/10; F28F 1/42

[52] U.S. Cl. ..... 165/119; 165/51; 165/154; 165/916; 123/41.33; 184/104.1; 184/104.3; 210/184; 210/186

[58] Field of Search ..... 165/103, 51, 119, 154, 165/916; 123/41.33, 196 AB; 184/6.22, 104.3; 210/184, 186

[56] References Cited

U.S. PATENT DOCUMENTS

| | | | |
|---|---|---|---|
| 1,816,430 | 7/1931 | Godward | 165/154 |
| 1,900,821 | 3/1933 | Kline | 210/186 |
| 3,450,199 | 6/1969 | Warrell | 165/154 |
| 3,509,867 | 5/1970 | Brosens et al. | 165/154 |
| 3,696,620 | 10/1972 | Pace | 165/103 |
| 4,305,457 | 12/1981 | Cozzolino | 165/154 |
| 4,368,777 | 1/1983 | Grasso | 165/154 |
| 4,395,997 | 8/1983 | Lee, Sr. | 165/51 |
| 4,633,939 | 1/1987 | Granetzke | 165/154 |

FOREIGN PATENT DOCUMENTS

| | | | |
|---|---|---|---|
| 0042613 | 6/1981 | European Pat. Off. . | |
| 2747846 | 5/1978 | Fed. Rep. of Germany . | |
| 543857 | 9/1922 | France | 165/154 |
| 73071656 | 5/1981 | Sweden . | |
| 80044704 | 2/1983 | Sweden . | |
| 209081 | of 1924 | United Kingdom . | |
| 86/00395 | 1/1986 | World Int. Prop. O. . | |

OTHER PUBLICATIONS

Mitsubishi, "Strainer", *Patent Abstract of Japan*, vol. 7, No. 177 (M-233), (May 14, 1983).

*Primary Examiner*—John Ford

*Attorney, Agent, or Firm*—Browdy and Neimark

[57] ABSTRACT

A heat exchanger for exchange of heat between two liquid media, particularly an oil-water-heat exchanger for cooling engine or transmission oil in an automotive vehicle with the aid of the cooling water flow of the engine, comprises two heat-exchange chambers (1, 2) mutually separated by a common liquid-impervious partition wall (3) and intended to be through-passed by a respective one of the media. The partition wall (3) is tubular with a circular cross-section and open axial ends forming an inlet and an outlet for the water. The heat-exchange chamber (1) for the water is annular and located radially inwards of the partition wall and encloses a direct flow path for the water from the inlet (4) to the outlet (5), and communicates with the direct flow path in a manner such that only part of the total water flow through the inlet (4) will pass through the said heat-exchange chamber (1), whereas the remainder of the water will flow along the direct flow path to the outlet (5). The other heat-exchange chamber (2) intended for the oil is annular and encircles the outer surface of the tubular partition wall (3).

7 Claims, 1 Drawing Sheet

HEAT EXCHANGER

BACKGROUND

The present invention relates to a heat exchanger intended for effecting an exchange of heat between two liquid media and comprising two heat-exchange chambers which are separated from one another in a liquid-tight fashion by means of a common liquid-impervious partition wall, and each of which is intended to be through-passed by a respective one of such two liquid media.

The heat exchanger according to this invention was developed primarily for use in automotive vehicles for cooling lubricating oil or hydraulic oil with the aid of the engine cooling water as the cooling medium.

The internal combustion engine of automotive vehicles is cooled primarily with water, or commonly with a mixture of water and glycol, which in turn is cooled in an air-water-cooler. In order not to subject the engine to excessive thermal stresses, the temperature of the water coolant is changed only to an insignificant extent during its passage through the air-water-cooler. Consequently, it is necessary to use a very large volumetric flow of cooling water in order to achieve the requisite engine cooling effect. In the case of modern engines, there is also a need to cool the engine oil, and in many cases also the oil in the vehicle transmission system. This can be achieved with the aid of air or by using the engine-cooling water as a coolant. Earlier it was quite usual to cool the oil by means of an air-cooler, but this method has become progressively less usual, since the coolers involved are bulky and a large number of coolers are required, which makes it difficult to utilize the cooling air-flow effectively. Consequently, it has become more usual to cool the oil with the engine cooling water as the coolant. In principle this can be effected in two different ways. The first of these methods involves the embodiment of a water-oil-cooler in the collecting box of the engine air-water-cooler. This arrangement is often used for cooling the oil in automatic gear boxes. In this case, the oil is led to the engine air-water-cooler through hoses. The second of the aforesaid methods involves passing the flow of engine cooling water, or a part thereof, to a water-oil-cooler which is placed close to the component whose oil is to be cooled. Thus, in this case it is water which is passed through hoses to the oil-water-cooler. One example of this particular arrangement is found in the engine oil coolers which are fitted between the engine block and the oil filter. Only a part of the total flow of engine cooling water is passed through these oil coolers. Since according to the first of the aforesaid methods, an oil cooler is placed in the collecting box of the engine air-water-cooler, it is difficult to avoid disturbing the function of the air-water-cooler, which is of prime importance for cooling the engine, or to avoid impairing the oil cooling conditions. Since according to the second of the aforesaid methods the oil-water-coolers are placed in the close vicinity of the components whose oil is to be cooled, a large amount of space is required to accommodate the oil-water-coolers of present day construction and a comprehensive and complicated network of pipes and hoses is required to conduct the cooling water to the coolers. Furthermore, conventional oil-water-coolers require a troublesome high pressure drop for the flow of cooling water, which is a drawback in engine-cooling-water systems.

SUMMARY

Consequently, an object of the present invention is to provide firstly a heat exchanger which can be used with particular advantage for cooling the engine oil and transmission oil of automotive vehicles with the aid of the flow of engine cooling water; secondly a heat exchanger which can be given a small total volume and, despite this, a high heat-exchange efficiency; and thirdly a heat exchanger which can be placed at any suitable, desired location in the cooling water circuit of the engine with only a very slight increase in the pressure drop in the cooling water flow as a result thereof.

The primary characteristic features of a heat exchanger constructed in accordance with the invention are set forth in the following claims.

When the inventive heat exchanger is used as an oil cooler in an automotive vehicle, a very large flow of cooling water, e.g. all of the engine cooling water, may be passed straight through the heat exchanger, with only very small flow losses and only a very slight drop in pressure, wherewith only that part of the flow of cooling water needed for the heat-exchange requirement in question is passed through the heat-exchange chamber located inwardly of the tubular partition wall, while the oil flows through the heat-exchange chamber which is located outwardly of the tubular partition wall. Such an oil cooler can be fitted in a hose intended for conducting cooling water. If desired, the cooler can be given an external diameter which is only slightly larger than the external diameter of the hose. An oil cooler which is constructed in accordance with the invention can also be integrated with or embodied in the engine at a location in which the cooling water flows. This obviates the need for auxiliary external conduits, in the form of pipes or hoses. When cooling transmission oil and the engine and transmission are integrated to form a rigid unit or assembly, the conduits required may consist of rigid pipes, therewith eliminating the need for flexible hoses.

Both of the heat-exchange chambers of the inventive heat exchanger may be configured for turbulent flow of the medium flowing through said chambers, in accordance with present day standard heat-exchange principles. However, a particular advantage is afforded when one or both of the heat-exchange chambers of an inventive heat exchanger is or are configured to engender laminar flow of the through-passing medium, and to work in accordance with the heat-exchange principle described in International Patent Application PCT/SE 84/00245, corresponding to U.S. Ser. No. 06/847,659. This heat-exchange principle affords a very high heat-exchange effect per unit of volume of the heat exchanger. This can also be achieved with a relatively small volumetric flow and also with a low pressure-drop of the through-flowing medium.

When using a heat exchanger constructed in accordance with the invention as a water-oil-cooler, the oil flowing through the outer chamber of the heat exchanger has unfavourable heat exchange characteristics and the volumetric flow of said oil is normally comparatively small. Consequently, it is particularly beneficial in this case to configure the outer heat-exchange chamber for laminar flow of the oil and in accordance with the heat-exchange principle taught in the aforementioned international patent application. The volumetric flow of oil in, e.g., internal combustion engines is contingent on the engine lubricating requirements and is relatively small, so that conventional heat-transfer functions which work with turbulent flow would result in an inventive heat exchanger of impracticable large volume. In the case of automatic gear boxes, the requisite volumetric oil flow is governed by the requirements of the transmission system and is, in this case, so small as to result in an inventive heat exchanger of impracticably large dimensions when the heat exchanger is constructed for turbulent oil flow. Since the cooling requirement lies close to the maximum requirement possible with regard to the volumetric oil flow, it is obvious that the best possible heat exchange principle should be used. The engine cooling water used to cool the oil has very favourable heat-transfer properties and is also present in large quantities, and consequently there can be used in the inwardly located heat-exchange chamber of the inventive heat exchanger either a conventional heat-exchange principle with turbulent flow, or the aforementioned heat-exchange principles with laminar flow, in accordance with the aforementioned patent application. The conventional heat-exchange principle with turbulent flow requires a greater volumetric flow through the inner heat-exchange chamber, i.e. that a greater part of the total cooling water flow is conducted through the inner chamber, and therewith requires an inner chamber of greater volume while, at the same time, requiring a greater pressure drop across the inner chamber. The flow areas of such a heat-exchange chamber, however, will be relatively large and the risk of blockages occurring will thus be relatively small. On the other hand, the heat-exchange principle which employs laminar flow requires a significantly smaller volumetric flow through the inner heat-exchange chamber, resulting in a chamber of smaller volume and also a lower pressure drop across the same. The through-flow areas of such a chamber are smaller, however, and the risk of blockages occurring therein are consequently greater, therewith heightening the need to use clean cooling water.

BRIEF DESCRIPTION OF DRAWING

The invention will now be described in more detail with reference to the accompanying schematic drawing, which illustrates by way of example an advantageous embodiment of the inventive heat exchanger and in which.

Figure 1:
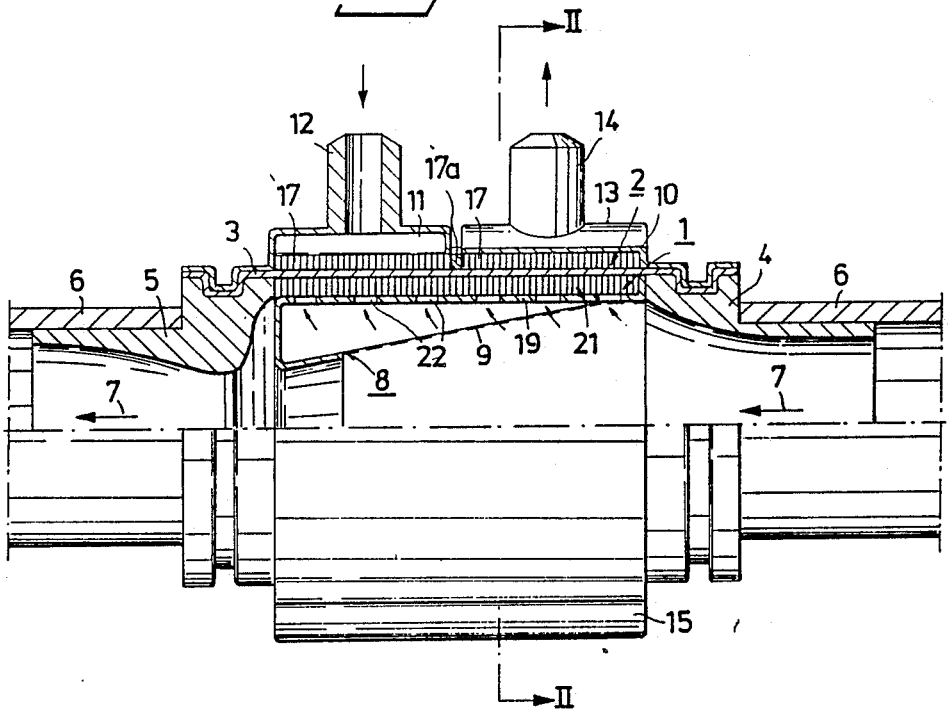
FIG. 1 is a side view, partly in axial section, of a heat exchanger constructed in accordance with the invention.

The illustrated inventive heat exchanger is configured, e.g., for cooling transmission oil in automotive vehicles with the use of the engine cooling water of the vehicle as the cooling medium.

DETAILED DESCRIPTION

The illustrated heat exchanger includes an inner, annular heat-exchange chamber, generally referenced 1, through which cooling water is intended to pass, and an outer, annular chamber, generally referenced 2, through which the oil is intended to pass, these chambers being separated from one another by a cylindrical, tubular liquid-impervious partition wall 3. The tubular partition wall 3 has fitted to respective ends thereof an inlet connector 4 and an outlet connector 5 by means of which a hose 6 which conducts engine cooling water can be connected to the heat exchanger. Thus, all of the cooling water will pass through the heat exchanger, as indicated by the arrow 7, wherewith only that part of the total cooling water flow which is required for heat exchange purposes is conducted through the inner chamber 1 in heat exchange contact with the partition wall 3, whereas the remaining part of the cooling water flow flows past the inner chamber 1, radially inwards thereof, without taking any appreciable part in the heat exchange process. This division of the cooling water is achieved as a result of the special configuration of the direct flow path of the cooling water radially inwards of the heat-exchange chamber 1, i.e. the path leading straight from the inlet connector 4 to the outlet connector 5. This direct flow path or channel is configured so as to engender a zone of relatively high pressure in which the inlet to the inner chamber 1 is located, and so as to engender a zone of relatively low pressure in which the outlet from the inner chamber is located. These zones can be generated in various different ways. For example, there may be provided in the direct flow channel for cooling water, a rigid or flexible throttle means, or alternatively, and even preferably, a variable, elastic throttle means which will conform to the volumetric flow of the cooling water, such as to create upstream of the throttle means a zone of relatively high pressure in which the inlet to the inner chamber 1 can be located, and such as to create downstream of the throttle means a zone of relatively low pressure in which the outlet from the inner chamber 1 can be located.

In the case of the illustrated, preferred embodiment, the desired zones of mutually different pressures are created by configuring the inlet connector 4 to form a diffuser which has a gradually increasing flow area, so that the flow rate will fall and the static pressure increase. Furthermore, there is arranged coaxially inwards of the inner heat-exchange chamber 1 a cylindrical wall, generally referenced 8, which tapers conically towards the outlet and which partially comprises a screen device or filter wall 9 which functions as an inlet to the inner chamber 1, as described in more detail hereinafter. The cylindrical conically, tapering wall 8 forms an ejector which increases the velocity of the liquid flow and lowers the static pressure, the outlet from the inner chamber being located at the downstream end of said wall, as described in more detail hereinafter. The outlet connector 5 also has the form of a diffuser which has a gradually increasing area in the flow direction, such as to recover as much as possible of the kinetic energy generated in the ejector, so that the total pressure drop of the flow of the cooling water through the heat exchanger will be low.

The inner heat-exchange chamber 1 and the outer heat-exchange chamber 2 of the illustrated, advantageous embodiment of an inventive heat exchanger are both configured for laminar flow of the flowing medium, in accordance with the heat-exchange principle described in the aforementioned international patent application.

The outer chamber 2, through which the oil flows, lies between the tubular partition wall 3 and the sleeve-like outer wall 10 which extends co-axially with and around the partition wall 3 at a radial distance therefrom, and the axial ends of which are connected to the outer surface of the partition wall in a liquid-tight manner. The cylindrical outer wall 10 has formed therein an axially extending inlet chamber 11, which is provided with an oil-inlet pipe stub 12 and which extends along half the axial length of the chamber 2, and also an axially extending outlet chamber 13 which extends in line with the inlet chamber 11 and is provided with an oil-outlet pipe stub 14 and extends along the remaining half of the heat-exchange chamber 2. At a location diametrically opposite the inlet chamber 11 and the outlet chamber 13, the cylindrical outer wall 10 has formed therein an axially extending connecting chamber 15 which extends along the whole length of the heat-exchange chamber 2. Formed integrally with the outer surface of the partition wall 3 are a large number of peripherally extending fins 16 which define therebetween peripherally extending, slot-like flow channels in which the oil can flow in laminar fashion. The fins 16 are broken at a location opposite the inlet chamber 11 and the outlet chamber 13 by an axially extending channel 17, which is divided into two halves by a transverse wall 17*a*, of which halves one is located radially inwards of the inlet chamber 11 and the other radially inwards of the outlet chamber 13. The fins 16 are also broken in a similar manner at a location opposite the connecting channel 15, by an axially extending channel 18 which extends unbroken along the entire axial length of the heat-exchange chamber 2. The oil thus flows in through the inlet 12 and into the inlet chamber 11, and from there to the left-hand part of the channel 17 as seen in FIG. 1. The oil leaves the channel 17 and disperses through the peripherally extending slot-like flow channels between the fins 16, in which the oil flows in laminar flow in a peripheral direction to the axially extending channel 18 and the connecting channel 15. The oil flows in a turbulent fashion in the connecting channel 15 and into the right-hand part of the heat-exchanger as seen in FIG. 1, where the oil again disperses from the axial channel 18 and into the peripherally extending, slot-like flow channels between the fins 16, in which the oil flows peripherally in a laminar fashion, as shown by arrows in FIG. 2, up to the right-hand half of the axial chamber 17, as seen in FIG. 1, and the outlet chamber 13 located externally of said channel 1. The oil then leaves the heat exchanger through the outlet 14. The outer heat-exchange chamber 2 is thus divided into two halves which are connected in series and each of which is through-passed by oil in sequence, which from the aspect of heat exchange affords a more favourable temperature difference between the oil and the cooling water flowing through the inner heat-exchange chamber 1.

The inner heat-exchange chamber 1 is defined by the tubular partition wall 3 and a substantially cylindrical plate 19 which extends co-axially with and radially inwards of the partition wall 3, one axial end of the cylindrical plate 19 being bent or curved to form the narrowest part of the aforementioned ejector surface 8. The inner surface of the partition wall 3 is also provided with peripherally extending fins, here referenced 20, which are integral with said surface and which define therebetween slot-like flow channels, in which the cooling water flows in laminar fashion. The fins 20 are broken by four axially extending channels 21 which are distributed uniformly around the periphery and into which the cooling water flows via the conical screen structure 9 and apertures 22 provided in the plate 19, as indicated by arrows in FIG. 1. The cooling water flows from the axially extending channels 21 into the peripherally extending, slot-like flow channels between respective fins 20, and flows peripherally in said channels, as indicated by arrows in FIG. 2, and into channels 23 which interrupt the axially extending fins 20. At a location inwardly of the channels 23 the cylindrical plate 19 presents inwardly curved, axially extending channels 24, here referred to as troughs, the flow area of which increases progressively in a direction towards the outlet connector 5 and in which the cooling water, subsequent to passing through the heat-exchanger chamber 1, is collected and conducted to the open ends of the troughs 24 downstream of the aforementioned ejector. As previously described, part of the total flow of cooling water is passed through the chamber 1 under the influence of the difference in the pressures prevailing upstream and downstream of the ejector.

The filter or screen structure 9, which forms part of the ejector, is supported against the inwardly facing apeces of the troughs formed in the cylindrical plate 19 and forming the channels 24. The inflow of cooling water to the heat-exchange chamber 1 through the screen 9 thus takes place in a direction which is substantially perpendicular to the direct flow path of the cooling water from the inlet connector 4 to the outlet connector 5. An advantage is afforded when the through-flow area of the filter or screen 9 is such that the flow rate of the water therethrough is much lower than the rate of flow of the water along the surface of said filter or screen and so that a low pressure drop is obtained across the filter in relation to the pressure drop across the inner heat-exchange chamber 1 and also in relation to the dynamic pressure in the direct flow path of cooling water from the inlet connector 4 to the outlet connector 5. When these conditions are fulfilled, particles and contaminants which may be liable to block the flow channels in the inner chamber 1 will not pass through the filter 9, and neither will particles be able to fasten to the inner surface of the filter and clog the same. Instead, these particles and other contaminants are flushed away, along the filter 9. It will be understood that the filter 9 may be replaced with some other surface which is perforated to allow the passage of the cooling water.

Figure 2:
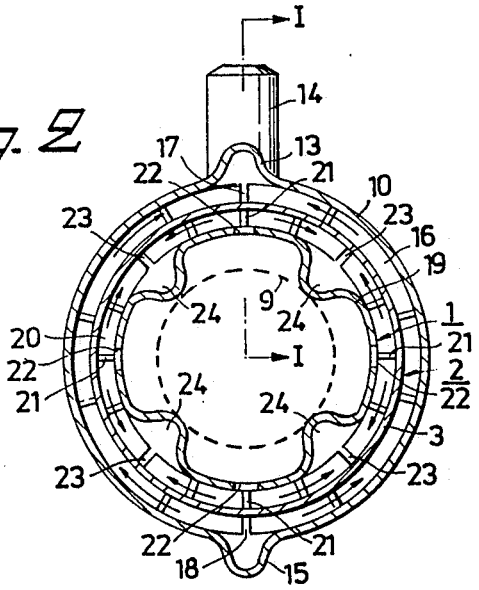
FIG. 2 is a radial sectional view of the heat exchanger of FIG. 1.

As illustrated in FIG. 2, the fins 16 in the outer heat-exchange chamber 2 and the fins 20 in the inner heat-exchange chamber 1 are broken by means of a plurality of narrow, axially extending slots, the function of which is described in detail in the aforementioned international patent specification.

Although in the aforegoing there has been described primarily a heat exchanger which is constructed as a water-oil-cooler for cooling engine oil and transmission oil in automotive vehicles, it will be understood that a heat exchanger constructed in accordance with the invention can be used advantageously for many other purposes.

I claim:

1. A heat exchanger for effecting an exchange of heat between two liquid media and comprising means forming two heat-exchange chambers which are separated from one another in a liquid-tight fashion by means of a common liquid-impervious partition wall, and each of which is intended to be through-passed by a respective one of said media, characterized in that the partition wall is essentially tubular and has a substantially circular cross-section and open, axial ends which form an inlet and an outlet respectively for said one medium; in that the one heat-exchange chamber for said one medium is annular in shape and is located on the radially inward side of the tubular partition wall and encloses a direct flow path for said one medium from the inlet to the outlet at mutually opposite ends of the partition wall, and communicates with said direct flow path in a manner such that solely a part of the medium flowing in through said inlet passes through said one heat-exchange chamber while the remainder of said flow passes along said direct flow path to the outlet without passing through said one-heat exchange chamber; and in that the other heat-exchange chamber intended for the other of said media is annular in shape and extends around the outer surface of the tubular partition wall; wherein the partition wall is provided on its inner surface with a large number of peripherally extending fins which define therebetween peripherally extending, slot-like flow channels for said one medium; in that the fins are broken by a plurality of axially extending slots which are uniformly distributed around the periphery and which function alternately as distribution channels and collecting channels for said first medium to and from said peripherally extending flow channels respectively; in that the distribution channels communicate with said direct flow path through openings provided in a cylindrical sleeve which is located inwardly of said fins and which abuts the radially inward edges of the fins; and in that the collecting channels communicate with said direct flow path through axially extending, inwardly curved channels or troughs which are open in the downstream direction and which are formed in said cylindrical sleeve.

2. A heat exchanger for effecting exchange of heat between a first liquid medium and a second liquid medium, comprising a tubular structure with a substantially circular cross-section, a liquid impervious wall and open axial ends forming an inlet and an outlet respectively for said first medium and forming a continuous and permanently open flow path for a main flow of said first medium from said inlet end to said outlet end; a first heat-exchange chamber with an annular substantially circular cross-section coaxially encircling said main flow path of said tubular structure; and a second heat-exchange chamber with an annular substantially circular cross-section encircling coaxially said first heat-exchange chamber; said first and second heat-exchange chambers being separated from one another in a liquid-tight fashion by a common liquid-impervious partition wall forming part of the liquid-impervious wall of said tubular structure; said second heat-exchange chamber having an inlet and an outlet for a flow of said second medium; said first heat-exchange chamber having at least one inlet opening and at least one outlet opening communicating with said main flow path of said tubular structure with the inlet opening located upstream of the outlet opening with respect to the flow in said main flow path; and said main flow path of said tubular structure having means creating at said inlet opening of said first heat-exchange chamber a local static pressure which is higher than the static pressure at the axial inlet end of said tubular structure and means creating at said outlet opening of said first heat-exchange chamber a local static pressure which is lower than the static pressure at the axial outlet end of said tubular structure so that the pressure difference between said inlet opening and said outlet opening of said first heat-exchange chamber is larger than the pressure difference between the axial inlet end and the axial outlet end of said tubular structure and so that a part of said main flow is diverted to flow through said first heat-exchange chamber via said inlet and outlet openings thereof; said main flow path of said tubular structure having a substantially circular cross-section with a diameter which increases gradually from said axial inlet end to a location at said inlet opening of said first heat-exchange chamber, decreases gradually from a location at said inlet opening of said first heat-exchange chamber to a location at said outlet opening of said first heat-exchange chamber, and increases gradually from a location at said outlet opening of said first heat-exchange chamber to said axial outlet end of said tubular structure; the part of said main flow path having a gradually decreasing diameter being defined by a substantially frustoconical surface, said surface having over a part of its length closest to its wider end a plurality of inlet openings to said first heat-exchange chamber.

3. A heat exchanger as claimed in claim 2, wherein said part of said frustoconical surface having said plurality of inlet openings has the form of a screening surface.

4. A heat exchange for effecting exchanger of heat between a first liquid medium and a second liquid medium, comprising a tubular structure with a substantially circular cross-section, a liquid impervious wall and open axial ends forming an inlet and an outlet respectively for said first medium and forming a continuous and permanently open flow path for a main flow of said first medium form said inlet end to said outlet end; a first heat-exchange chamber with an annular substantially circular cross-section coaxially encircling said main flow path of said tubular structure; and a second heat-exchange chamber with an annular substantially circular cross-section encircling coaxially said first heat-exchange chamber; said first and second heat-exchange chambers being separated from one another in a liquid-tight fashion by a common liquid-impervious partition wall forming part of the liquid-impervious wall of said tubular structure; said second heat-exchange chamber having an inlet and an outlet for a flow of said second medium; said first heat-exchange chamber having at least one inlet opening and at least one outlet opening communicating with said main flow path of said tubular structure with the inlet opening located upstream of the outlet opening with respect to the flow in said main flow path; and said main flow path of said tubular structure having means creating at said inlet opening of said first heat-exchange chamber a local static pressure which is higher than the static pressure at the axial inlet end of said tubular structure and means creating at said outlet opening of said first heat-exchange chamber a local static pressure which is lower than the static pressure at the axial outlet end of said tubular structure so that the pressure difference between said inlet opening and said outlet opening of said first heat-exchange chamber is larger than the pressure difference between the axial inlet end and the axial outlet end of said tubular structure and so that a part of said main flow is diverted to flow through said first heat-exchange chamber via said inlet and outlet openings thereof.

5. A heat exchanger as claimed in claim 4, wherein said main flow path of said tubular structure has a substantially circular cross-section with a diameter which increases gradually from said axial inlet end to a location at said inlet opening of said first heat-exchange chamber, decreases gradually from a location at said inlet opening of said first heat-exchange chamber to a location at said outlet opening of said first heat-exchange chamber, and increases gradually from a location at said outlet opening of said first heat-exchange chamber to said axial outlet end of said tubular structure.

6. A heat exchanger as claimed in claim 4, wherein said partition wall is provided on its inner surface with a large number of peripherally extending fins defining therebetween peripherally extending, slot-like flow channels for said first medium, said fins being broken by a plurality of axially extending interruptions uniformly distributed around the periphery and forming alternately axially extending distribution channels and collecting channels for said first medium to and from said peripherally extending flow channels respectively, said distribution channels communicating with said main flow path through inlet openings provided in a substantially cylindrical sleeve located inwardly of said fins and abutting the radial inward edges of said fins; and said collecting channels communicating with said main flow path through axially extending, inwardly curved troughs which are formed in said sleeve and are open in the downstream direction.

7. A heat exchanger as claimed in claim 4, wherein said partition wall is provided on its outer surface with a large number of peripherally extending fins defining therebetween peripherally extending slot-like flow channels for said second medium, said fins being encircled by a substantially cylindrical sleeve abutting the radially outward edges of said fins and configured to present two axially extending and sequentially arranged chambers, each of which extends over a respective half of the axial length of said partition wall and which are provided with said inlet and said outlet for said second medium, and a third chamber extending axially along the total axial length of said partition wall diametrically opposite said first and second chambers.

* * * * *